United States Patent [19]

Moses

[11] 4,109,858

[45] Aug. 29, 1978

[54] SYSTEM FOR THE UTILIZATION OF WASTE HEAT FROM A BOILER ROOM TO HEAT A FLUID MEDIUM AND LOWER THE AMBIENT TEMPERATURE OF A BOILER ROOM

[76] Inventor: Manfred Moses, 29 Huntley Rd., Eastchester, N.Y. 10709

[21] Appl. No.: 803,540

[22] Filed: Jun. 6, 1977

Related U.S. Application Data

[63] Continuation-in-part of Ser. No. 666,444, Mar. 12, 1976, abandoned.

[51] Int. Cl.[2] ..... F24D 3/02; F24D 9/00

[52] U.S. Cl. ..... 237/8 R; 237/56; 237/1 R; 165/DIG. 2

[58] Field of Search ..... 237/56, 63, 13, 12.1, 237/1 A, 1 R, 1 SL, 8 R; 34/35, 86; 165/107, DIG. 2; 62/238

[56] References Cited

U.S. PATENT DOCUMENTS

| | | | |
|---|---|---|---|
| 576,718 | 2/1897 | Bolton | 237/12.1 |
| 1,028,030 | 5/1912 | Kitchen | 237/12.1 |
| 1,214,255 | 1/1917 | Altenkirch et al. | 237/13 |
| 2,072,427 | 3/1937 | O'Brien | 62/435 |
| 3,096,021 | 7/1963 | Lintvedt | 237/8 R |
| 3,473,603 | 10/1969 | Fujie | 165/90 |
| 3,896,992 | 7/1975 | Borovina et al. | 237/8 R |

OTHER PUBLICATIONS

Control Systems for Heating, Ventilating and Air Conditioning by Roger W. Haines (pp. 123–126).

*Primary Examiner*—John J. Camby
*Assistant Examiner*—Henry C. Yuen
*Attorney, Agent, or Firm*—McAulay, Fields, Fisher & Goldstein

[57] ABSTRACT

A system for lowering the temperature of a room where a substantial amount of waste heat is generated, and utilizing the waste heat removed from the room, includes a portion mounted within the room to absorb the heat from the room and a portion external to the room, operable to utilize the heat.

The portion mounted in the room includes at least one heat exchanger along with associated means for moving the hot air of the room through the heat exchanger and means for conducting fluid through the heat exchanger and to the external portion of the system.

7 Claims, 2 Drawing Figures

SYSTEM FOR THE UTILIZATION OF WASTE HEAT FROM A BOILER ROOM TO HEAT A FLUID MEDIUM AND LOWER THE AMBIENT TEMPERATURE OF A BOILER ROOM

CROSS REFERENCE TO RELATED APPLICATION

This application is a continuation-in-part of prior copending application Ser. No. 666,444 filed Mar. 12, 1976 (now abandoned) by Manfred Moses for "System For The Utilization Of Waste Heat From A Boiler Room To Heat A Fluid Medium And Lower The Ambient Temperature Of A Boiler Room."

BACKGROUND OF THE INVENTION

This invention relates to a system for the utilization of waste heat from a room where waste heat is generated, such as a boiler room, equipment room, power plant and the like, to heat a fluid and thereby lower the ambient temperature of the room. The heated fluid may thereafter be used directly, as in a hot water system, or may be pumped through a secondary heat exchanger whereby the heat may be extracted for other purposes.

The room where waste heat is generated will hereinafter be referred to as a boiler room.

It is well known that the temperature of the air in a boiler room is often so high as to make it unbearable for an individual to remain in a boiler room for an extended period of time. Methods and systems which have previously been used for reducing the ambient temperature in boiler rooms generally include such as air conditioning systems, exhaust systems and various forms of boiler area insulation. It has been found however, that even where the systems are effective for their intended purposes, a large amount of usable heat is still wasted. In addition, some of the prior systems, especially air conditioning systems utilizing compressors, are costly to operate.

It is therefore an object of the present invention to provide a system which overcomes the aforesaid disadvantages by removing waste heat from a boiler room and thereafter utilizing such waste heat, without requiring the costly mechanisms employed by some of the prior art systems.

As mentioned heretofore, systems for the removal of heat from a room, and systems for the use of excess heat from a boiler are both well known. For example, U.S. Pats. Nos. 1,697,591 to Dowd, Jr.,; 1,710,529 to Bell; 1,871,166 to Fahrbach and 3,242,976 to Morton, are concerned with the use of boiler flue gases to pre-heat entering combustion air, and these are basically used as a pre-heater for the boiler. However, while these systems may have the effect of reducing the boiler room air temperature, it is still necessary with these systems to use boiler room air conditioning units and exhaust systems with their attendant expense and waste of energy.

There are other types of pre-heaters, such as the pre-heating of air for a dryer for a commercial laundry as disclosed in U.S. Pat. No. 3,194,308 to Haried, a heat saver for a coal burning boiler as disclosed in U.S. Pat. No. 3,327,689 to Methmann, and a recuperator for gas turbine power plants as disclosed in U.S. Pat. No. 3,267,673 to Hernsworth et al. But, while these patents are concerned with the use of pre-heaters, there is no suggestion for the removal of heat from the ambient air in a boiler room nor for the recovery or use of the removed heat.

U.S. Pat. No. 1,878,542 to Richardson, which relates to a method and apparatus for conditioning mine air by forcing the hot mine air through a curtain of water in order to cool the air, and thereafter cooling the water by heat exchange with brine in turn cooled in a water tower, does not suggest cooling a boiler room or using the heat removed therefrom.

In summary, none of the above-referenced patents discloses using the heat from a boiler room to heat a fluid and thereafter removing the heated fluid from the boiler room so as to, on the one hand, reduce the temperature of the ambient air of the boiler room and, on the other hand, provide for a heated fluid medium which can be used directly or from which heat can be extracted, for some useful purpose.

SUMMARY OF THE INVENTION

This invention provides for a system in which one or more heat exchangers are placed in proximity with the boiler in a boiler room. Fluid, such as oil or water, which is to be heated is passed through the heat exchangers to absorb and remove the heat from the boiler room. In addition, fans are placed near the heat exchangers to assist in the direction and circulation of the hot air in the boiler room over the heat exchangers. A pump is also provided to pump the fluid through the heat exchangers in heat-exchange relationship with the hot air in the boiler room.

As an ancillary feature of the invention, the pump may be made temperature responsive to the temperature of the fluid leaving the heat-exchangers or the temperature in the boiler room, to control the rate of flow of the fluid through the heat exchangers. More preferably, temperature responsive valves are placed in the fluid flow line to control the rate of fluid circulation in response to room temperature. The fluid exiting from the heat exchangers is a fluid which has been heated by the waste heat from the boiler room. The heated fluid may be used for any purpose where a heated fluid is necessary, and the temperature of the boiler room is reduced without having to resort to expenses associated with the purchase, operation and energy losses inherent in air conditioning units or exhaust systems.

Other objects and advantages of the invention will be more fully understood from the following description of the preferred embodiments of the invention shown, by way of example, in the drawings wherein:

FIG. 1 is a schematic representation of the present invention in place in a boiler room and externally thereto; and, FIG. 2 is a schematic representation of the invention similar to FIG. 1 showing a modification.

DESCRIPTION OF THE PREFERRED EMBODIMENTS

Figure 1:
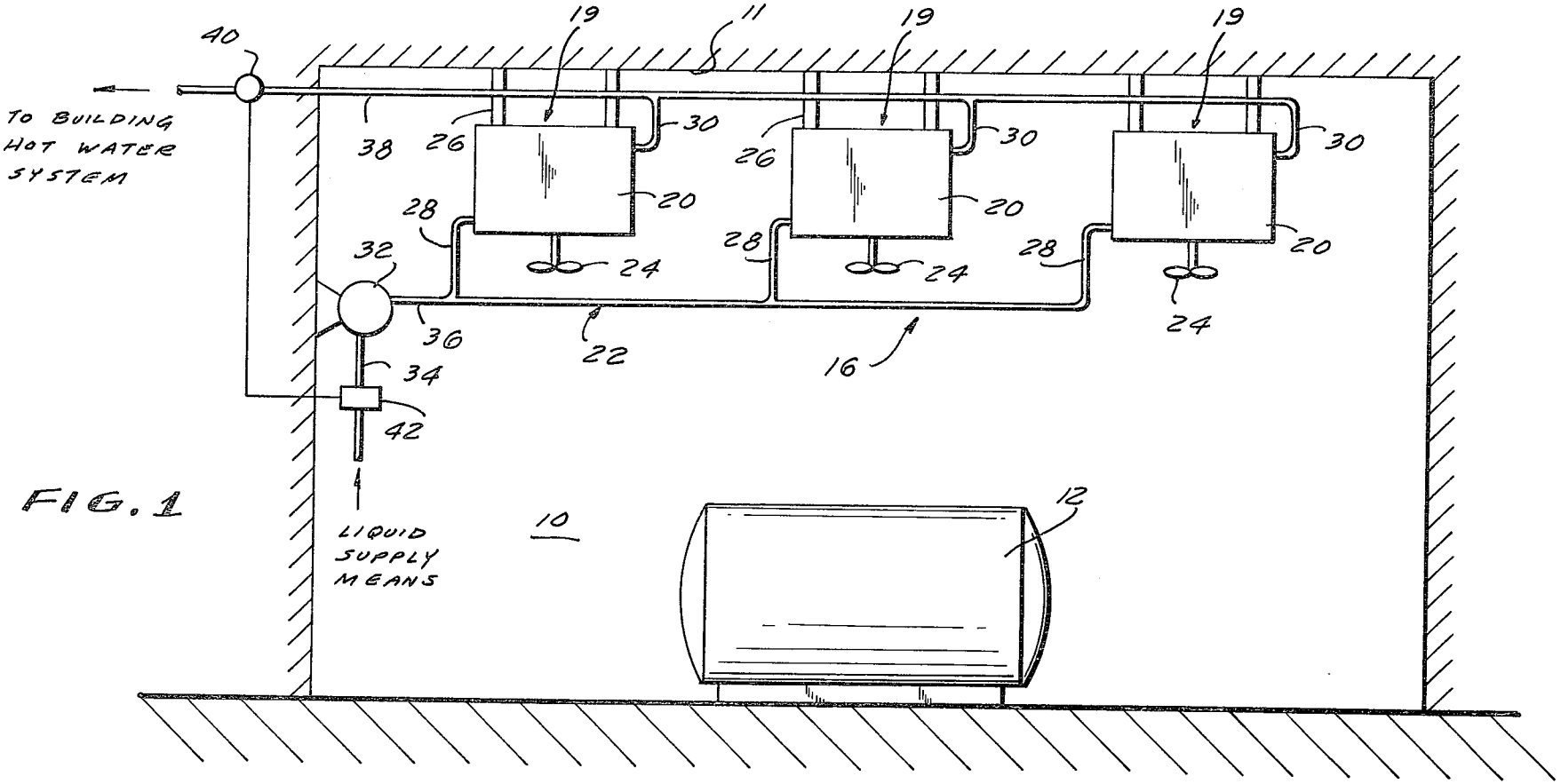

In the drawings, a boiler room 10 is shown containing a boiler 12 in proximity with the system 16 of the invention.

The basic system 16 includes heat exchange means 19 including at least one heat exchanger 20; conduit means 22 to conduct the fluid to be heated to the heat exchange means 19; a pump 32 to pump the fluid through the system; and outlet means or delivery pipe 38 to conduct the heated fluid from the heat exchanger 20 and externally of the boiler room 10. The heat exchanger 20 may be of any conventional construction, and most usually of the well known pipe-and-fin type construction. The heat exchanger 20 can be suspended from the ceiling of the boiler room 10 by means of hangers 26, and is provided with inlet 28 connecting it with conduit means 22, and outlet 30, connecting it to the outlet means 38.

The pump 32 includes an inlet 34 for supplying fluid to be heated to the pump 32, and an outlet 36 connected with the conduit means 22 and thereby the heat exchangers 20.

While only three heat exchangers 20 connected in parallel across the conduit means 22 and delivery pipe 38 are shown in the drawings, it would be obvious to a skilled worker in the art that any number can be analogously connected together, as required by the amount of heat which is to be removed from the boiler room 10 and on the circumstances of operating.

Figure 2:
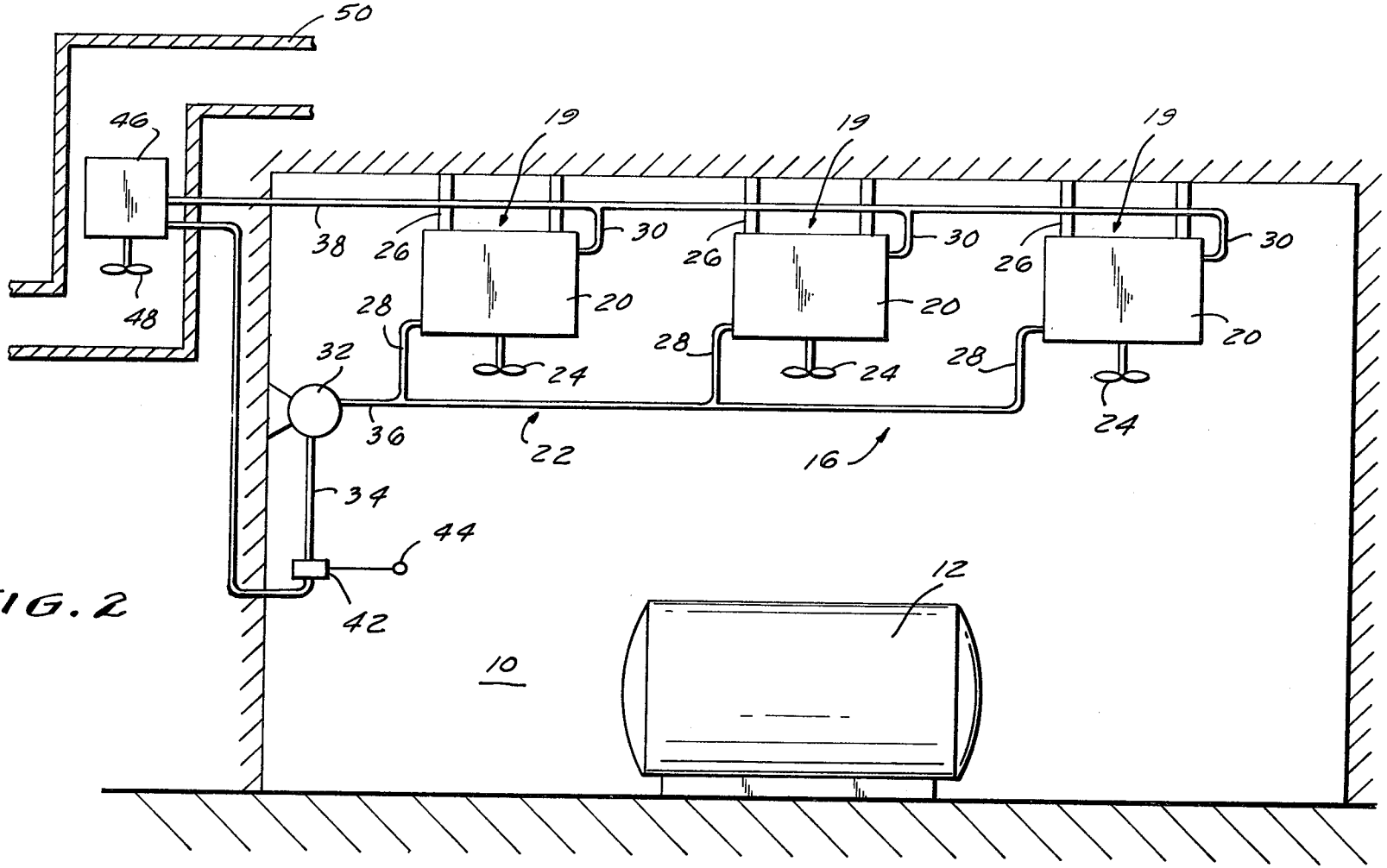

As shown in FIG. 1, a conventional temperature sensor 40 may be operably connected to, or in, the delivery or outlet pipe 38 and to a heat responsive control valve disposed in the inlet 34, to control the temperature of the fluid in the pipe 38 by varying the rate of fluid delivery to pump 32 through inlet 34. As shown in FIG. 2, in a similar manner, a temperature sensor 44 operably connected to the heat responsive control valve 42 may be used to sense the ambient temperature in the boiler room 10 and control the rate of fluid delivery in accordance with the boiler room temperature.

The fluid, which is circulated by pump 32, may be any liquid such as oil or water which is to be heated. The heat, which is normally lost in the boiler room, is now used to provide for the heating of the liquid which liquid may be used for any desired purpose directly or may be caused to give up its heat for some particular use. This results in both the utilization of otherwise lost heat to raise the temperature of a liquid and the reduction of the ambient temperature in the boiler room.

The waste heat from the boiler room, which is recovered by the fluid, especially oil or water, can be employed for a variety of purposes. As shown in FIG. 1, for example, when water is used it can be employed directly as a hot water source for the building. With either water or oil, the heated fluid may, again, be directly used by circulating it through the building heating system to provide part of the necessary heating requirement for the building.

A secondary heat exchanger 46 with associated fan 48, as shown in FIG. 2, may be provided as a part of the system 16, at a location remote from the boiler room 10, whereby the heat from the heated fluid may be transferred to another medium for use outside the boiler room 10. The secondary heat exchanger 46 may be of the same type of construction as the heat exchanger 20, or may be any convenient well known form. As shown in FIG. 2, it is mounted in a conduit 50 to warm air flowing therethrough. Other constructions or variations in the secondary heat exchanger would be obvious to a skilled worker in the art, depending on the final use for which the heat will be employed. For example, one of the well known liquid-to-liquid heat transfer devices can be used where it is desirous to pre-heat another liquid such as fresh water being provided to the boiler 12 to replenish water which may have been lost during operation or to preheat the fuel oil used to operate the boiler.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

What I claim is:

1. A heat recovery system, in combination with a boiler room for the removal and utilization of waste heat from said boiler room by passing a liquid in heat exchange relation with heated boiler room air and thereafter removing the heated liquid from the system, comprising:

heat exchange means mounted in said boiler room and including at least one heat exchanger operable to maintain liquid flowing therethrough in heat exchange relation with the air in said boiler room;

liquid distribution system including conduit means operable to conduct liquid into said heat exchanger, outlet means operable to conduct liquid away from said heat exchanger and externally of said boiler room; pump means to pump or move the liquid through the heat recovery system whereby liquid may be pumped through said heat exchanger and thereafter externally of said boiler room, thereby to remove heat from the boiler room air and from said boiler room, lowering the ambient temperature in said boiler room while simultaneously utilizing the heat to raise the temperature of the liquid; and a liquid supply operably connected to said pump means through an inlet to said pump, whereby liquid may be supplied to said pump and consequently to the system to replenish liquid which is continuously exhausted from the system;

said liquid distribution system further comprising a temperature sensor operably mounted on said outlet means to sense the temperature of the liquid flowing through said outlet means, and a heat responsive control valve operably mounted in the inlet to said pump and operably connected to said temperature sensor whereby the temperature of the liquid flowing through said outlet means controls the flow of liquid into said system.

2. The system as claimed in claim 1, wherein said liquid is water.

3. The system as claimed in claim 1 wherein said heat exchange means is of pipe-and-fin construction.

4. The system as claimed in claim 1 wherein said liquid is oil.

5. The system claimed in claim 1, wherein said heat exchange means further comprises air circulating means operable to circulate the air in said boiler room over said heat exchange means thereby to facilitate the operation of said heat exchange means in removing the waste heat from said boiler room.

6. The system as claimed in claim 5, wherein said air circulating means comprises a fan.

7. The system as claimed in claim 5 wherein said heat exchange means comprises a plurality of heat exchangers connected together in parallel.

* * * * *